US008360793B2

(12) United States Patent
Nagano et al.

(10) Patent No.: US 8,360,793 B2
(45) Date of Patent: Jan. 29, 2013

(54) CONNECTOR FITTING STRUCTURE AND ELECTRIC APPARATUS USING THE SAME

(75) Inventors: Shuji Nagano, Toyota (JP); Masabumi Nishigaya, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/144,503

(22) PCT Filed: Mar. 31, 2009

(86) PCT No.: PCT/JP2009/056609

§ 371 (c)(1),
(2), (4) Date: Jul. 14, 2011

(87) PCT Pub. No.: WO2010/113243

PCT Pub. Date: Oct. 7, 2010

(65) Prior Publication Data

US 2011/0275231 A1 Nov. 10, 2011

(51) Int. Cl.
*H01R 13/52* (2006.01)

(52) U.S. Cl. ..... 439/271

(58) Field of Classification Search ..... 439/272, 439/271, 282, 281

See application file for complete search history.

(56) References Cited

U.S. PATENT DOCUMENTS

| | | | | |
|---|---|---|---|---|
| 3,842,393 | A * | 10/1974 | Glover et al. | 439/281 |
| 4,417,736 | A * | 11/1983 | Herrmann, Jr. | 439/559 |
| 5,085,601 | A | 2/1992 | Buchter et al. | |
| 5,983,465 | A * | 11/1999 | Wakai et al. | 24/392 |
| 2002/0019176 | A1 | 2/2002 | Sasaki et al. | |
| 2004/0266269 | A1 | 12/2004 | Miyazaki | |
| 2004/0266270 | A1 | 12/2004 | Miyazaki | |

FOREIGN PATENT DOCUMENTS

| | | |
|---|---|---|
| JP | 61 186188 | 11/1986 |
| JP | 04 133280 | 5/1992 |
| JP | 04 286886 | 10/1992 |
| JP | 06 295764 | 10/1994 |
| JP | 10 241786 | 9/1998 |
| JP | 2001 250633 | 9/2001 |
| JP | 2002 075522 | 3/2002 |
| JP | 2004 186112 | 7/2004 |
| JP | 2005 019188 | 1/2005 |
| JP | 2005 019319 | 1/2005 |
| JP | 2005 276570 | 10/2005 |
| JP | 2006 344475 | 12/2006 |

OTHER PUBLICATIONS

International Search Report issued Apr. 28, 2009 in PCT/JP09/056609 filed Mar. 31, 2009.

* cited by examiner

*Primary Examiner* — Phuong Dinh
(74) *Attorney, Agent, or Firm* — Oblon, Spivak, McClelland, Maier & Neustadt, L.L.P.

(57) ABSTRACT

A connector fitting structure enabling easy insertion is provided. The connector fitting structure includes a case provided with a plurality of holes, a male connector having connectors fitted into the plurality of holes, respectively, and sealing elements as sealing members interposed between the holes and the connectors, respectively. Connectors each have a tapered surface. The respective tapered surfaces are shifted in position such that a tapered surface comes into contact with a sealing element, and then another tapered surface comes into contact with a sealing element.

9 Claims, 13 Drawing Sheets

CONNECTOR FITTING STRUCTURE AND ELECTRIC APPARATUS USING THE SAME

TECHNICAL FIELD

The present invention relates to a connector fitting structure, and more particularly, to a connector fitting structure for use in an electric apparatus.

BACKGROUND ART

A conventional connector fitting structure is disclosed in Japanese Patent Laying-Open No. 2005-19188 (Patent Document 1), for example.

Patent Document 1: Japanese Patent Laying-Open No. 2005-19188

DISCLOSURE OF THE INVENTION

Problems to be Solved by the Invention

With a conventional technique, the load during insertion of a connector into a sealing section is likely to increase.

The present invention was therefore made to solve the above-mentioned problem, and has an object to provide a connector fitting structure that can reduce the load during insertion into holes, and an electric apparatus using the same.

Means for Solving the Problems

A connector fitting structure in accordance with the present invention includes a case provided with a plurality of holes, connectors having a plurality of protruding portions fitted into the plurality of holes, respectively, and sealing members interposed between the holes and the protruding portions, wherein the plurality of protruding portions each have a tapered side surface, and the tapered surfaces of the respective protruding portions are shifted in position such that the tapered surface of a protruding portion comes into contact with a sealing element, and then another tapered surface comes into contact with a sealing element.

In the connector fitting structure configured in this manner, the tapered surface of a protruding portion comes into contact with a sealing element, and then the tapered surface of another protruding portion comes into contact with a sealing element, which can prevent a plurality of tapered surfaces from contacting a protruding portion. Therefore, the protruding portions can be fitted into the holes, respectively, without a large force being applied.

Preferably, the sealing member has an inner circumferential surface of a circular shape, and the tapered surface has an elliptical cone shape.

The electric apparatus in accordance with the present invention has any one of the above-described connector fitting structures.

Effects of the Invention

In accordance with the present invention, a connector fitting structure that can reduce the load during insertion into holes, and an electric apparatus using the same can be provided.

DESCRIPTION OF THE REFERENCE SIGNS

Figure 1:
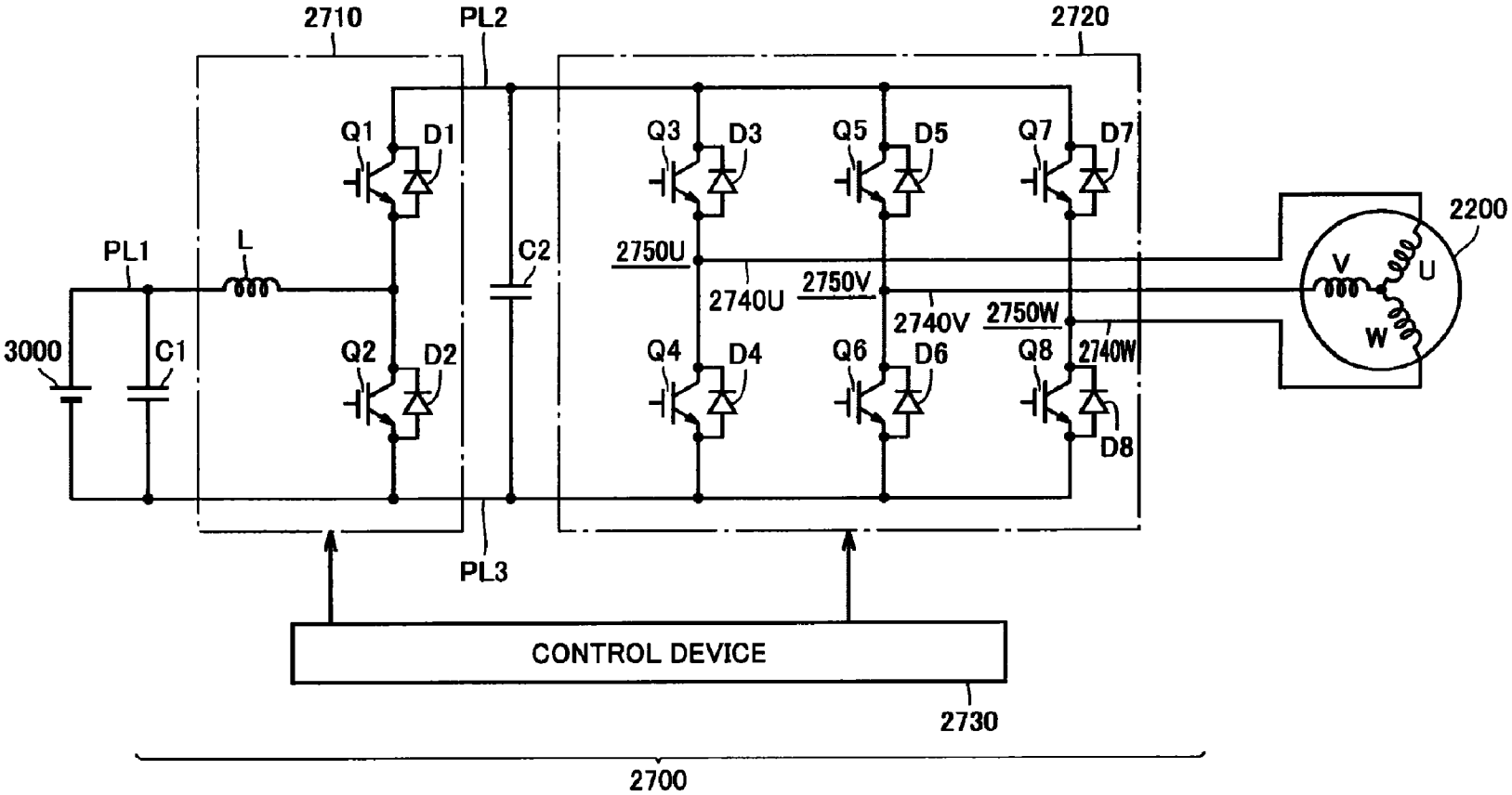
FIG. 1 is a diagram showing an electric circuit in a vehicle in which connectors in accordance with an embodiment of the present invention are used.

10 case; 10*h*1, 10*h*2, 10*h*3 holes; 20 male connector; 21, 22, 23, 31, 32, 33 connectors; 21*s*, 22*s*, 23*s*, 31*s*, 32*s*, 33*s* stepped portions; 21*t*, 22*t*, 23*t*, 31*t*, 32*t*, 33*t* tapered surfaces; 30 female connector; 41, 42, 43, 51, 52, 53 sealing elements;

41*a*, 42*a*, 43*a*, 51*a*, 52*a*, 53*a* protrusions; 2200 rotating electric machine; 2710 converter; 2720 inverter; 2730 control device.

BEST MODES FOR CARRYING OUT THE INVENTION

In the following, embodiments of the present invention will be described with reference to the drawings. It is noted that the same or corresponding parts are denoted by the same reference characters in the following embodiments, and description thereof will not be repeated. It is also possible to combine the respective embodiments.

First Embodiment

FIG. 1 is a diagram showing an electric circuit in a vehicle in which connectors in accordance with an embodiment of the present invention are used. With reference to FIG. 1, a PCU (power control unit) 2700 includes a converter 2710, an inverter 2720, a control device 2730, capacitors C1 and C2, power supply lines PL1 to PL3, and output lines 2740U, 2740V and 2740W. Converter 2710 is connected between a battery 3000 and inverter 2720, and inverter 2720 is connected to rotating electric machine 2200 via output lines 2740U, 2740V and 2740W.

Battery 3000 connected to converter 2710 is a nickel-metal hydride, lithium ion or similar secondary battery, for example. Battery 3000 supplies a generated DC voltage to converter 2710, and is charged with a DC voltage received from converter 2710.

Converter 2710 includes power transistors Q1 and Q2, diodes D1 and D2, and a reactor L. Power transistors Q1 and Q2 are connected in series between power supply lines PL2 and PL3, and each receive a control signal from control device 2730 at the base. Diodes D1 and D2 are connected between the collector and the emitter of power transistors Q1 and Q2, respectively, such that an electric current flows from the emitter to the collector of power transistors Q1 and Q2, respectively. Reactor L has one end connected to power supply line PL1 connected to the cathode of battery 3000 and the other end connected to a connection point between power transistors Q1 and Q2.

This converter 2710 boosts a DC voltage received from battery 3000 using reactor L, and supplies the boosted voltage to power supply line PL2. Converter 2710 also lowers a DC voltage received from inverter 2720 to charge battery 3000.

Inverter 2720 includes a U-phase arm 2750U, a V-phase arm 2750V, and a W-phase arm 2750W. Each phase arm is connected in parallel between power supply lines PL2 and PL3. U-phase arm 2750U includes power transistor Q3 and Q4 connected in series. V-phase arm 2750V includes power transistors Q5 and Q6 connected in series. W-phase arm 2750W includes power transistors Q7 and Q8 connected in series. Diodes D3 to D8 are connected between the collector and the emitter of power transistors Q3 to Q8, respectively, such that an electric current flows from the emitter to the collector of power transistors Q3 to Q8, respectively. A connection point of the respective power transistors in each phase arm is connected to the opposite sides of the neutral point of each phase coil of rotating electric machine 2200, which serves as a motor-generator, via output lines 2740U, 2740V and 2740W, respectively.

Inverter 2720 converts a DC voltage received from power supply line PL2 into an AC voltage based on a control signal from control device 2730 for output to rotating electric machine 2200. Inverter 2720 rectifies an AC voltage generated by rotating electric machine 2200 to a DC voltage for supply to power supply line PL2.

Capacitor C1 is connected between power supply lines PL1 and PL3, and smoothes the voltage level of power supply line PL1. Capacitor C2 is connected between power supply lines PL2 and PL3, and smoothes the voltage level of power supply line PL2.

Control device 2730 calculates a coil voltage in each phase of rotating electric machine 2200 based on a motor torque command value, a current value in each phase of rotating electric machine 2200, and a voltage input to inverter 2720, and generates a PWM (Pulse Width Modulation) signal that turns on/off power transistors Q3 to Q8 based on the calculated result for output to inverter 2720.

Control device 2730 also calculates a duty ratio of power transistors Q1 and Q2 for optimizing the voltage input to inverter 2720 based on the above-mentioned motor torque command value and the motor rotation speed, and generates a PWM signal that turns on/off power transistors Q1 and Q2 based on the calculated result for output to converter 2710.

Further, control device 2730 controls the switching operation of power transistors Q1 to Q8 in converter 2710 and inverter 2720 in order to convert AC power generated by rotating electric machine 2200 into DC power to charge battery 3000.

In PCU2700, converter 2710 boosts a DC voltage received from battery 3000 based on a control signal from control device 2730 for supply to power supply line PL2. Inverter 2720 then receives a DC voltage smoothed by capacitor C2 via power supply line PL2, and converts the received DC voltage into an AC voltage for output to rotating electric machine 2200.

Inverter 2720 also converts an AC voltage generated by a regenerative operation of rotating electric machine 2200 into a DC voltage for output to power supply line PL2. Converter 2710 then receives a DC voltage smoothed by capacitor C2 via power supply line PL2, and lowers the received DC voltage to charge battery 3000.

Figure 2:
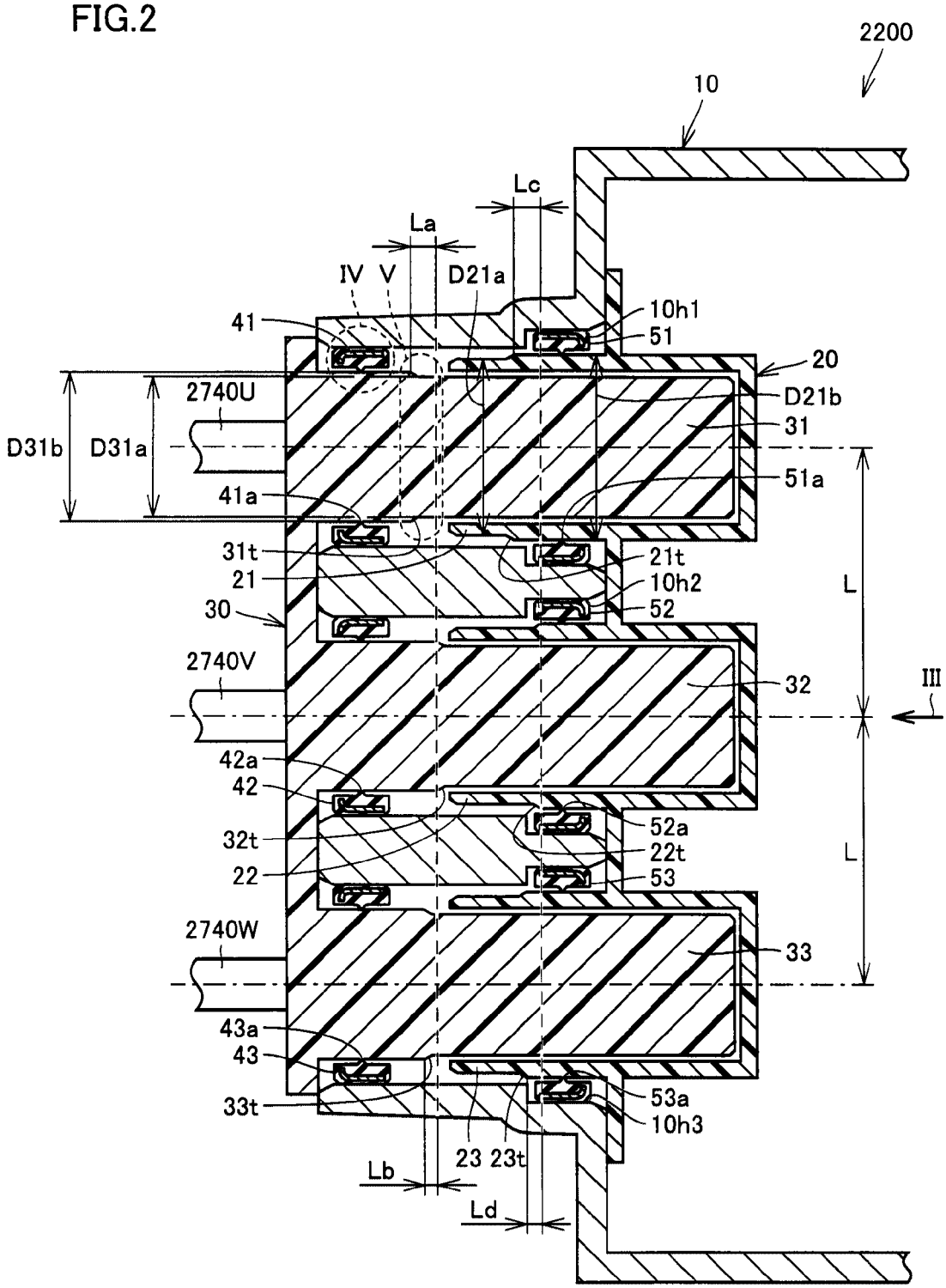
FIG. 2 is an enlarged cross sectional view showing a connected area between a rotating electric machine 2200 and an inverter shown in FIG. 1.

FIG. 2 is an enlarged cross sectional view showing a connected area between rotating electric machine 2200 and the inverter shown in FIG. 1. With reference to FIG. 2, rotating electric machine 2200 is housed in case 10. Case 10 has a hollow shape and accommodates rotating electric machine 2200 therein.

A plurality of holes 10*h*1, 10*h*2 and 10*h*3 provided in case 10 are arranged at regular intervals, and the distance between the centers of these holes is L. It is noted that, although three holes 10*h*1, 10*h*2 and 10*h*3 are provided in this example, the number of holes 10*h*1, 10*h*2 and 10*h*3 is not limited to this, and more or less holes 10*h*1, 10*h*2 and 10*h*3 may be provided.

Each of cylindrical holes 10*h*1, 10*h*2 and 10*h*3 is beveled at the rim. A male connector 20 is fitted into holes 10*h*1, 10*h*2 and 10*h*3. Male connector 20 has three connectors 21, 22 and 23 as protruding portions. Connectors 21, 22 and 23 are connected to and integrated with one another.

Sealing elements 51, 52 and 53 as sealing members are connected to connectors 21, 22 and 23, respectively.

Sealing element 51 has a cylindrical shape, and is interposed between case 10 and connector 21. Sealing element 52 has a cylindrical shape, and is interposed between case 10 and connector 22. Sealing element 53 has a cylindrical shape, and is interposed between case 10 and connector 23. The leading ends of sealing elements 51, 52 and 53 serve as protrusions 51*a*, 52*a* and 53*a*, and abut on the outer circumferential surfaces of connectors 21, 22 and 23, respectively.

Sealing elements 51, 52 and 53 each has a metal frame provided therein, the metal frame being surrounded with rubber.

The leading end of connector 21 has an outer diameter D21*a*, and the middle part has an outer diameter D21*b*. Outer diameter D21*b* is larger than outer diameter D21*a*.

Connector 21 is provided with a tapered surface 21*t* on the outer circumferential surface. Connector 22 is provided with a tapered surface 22*t*. Connector 23 is provided with a tapered surface 23*t* on the outer circumferential surface.

Relative to tapered surface 22*t*, tapered surface 23*t* is shifted in position by a distance Ld, and tapered surface 21*t* is shifted in position by a distance Lc.

Connectors 31, 32 and 33 constituting a female connector 30 are fitted into connectors 21, 22 and 23, respectively. The leading end of connector 31 has an outer diameter D31*a*, and the base part has an outer diameter D31*b*. Outer diameter D31*b* is larger than outer diameter D31*a*.

Connectors 31, 32 and 33 are integrated with one another, each of which has a recessed terminal not shown but formed at the right end face to constitute female connector 30. Output line 2740U is connected to connector 31, output line 2740V is connected to connector 32, and output line 2740W is connected to connector 33. Connectors 21, 22 and 23 are integrated with one another, each of which has a projecting terminal not shown but formed at a position to constitute male connector 20.

A sealing element 41 is interposed between case 10 and connector 31. A sealing element 42 is interposed between case 10 and connector 32. A sealing element 43 is interposed between case 10 and connector 33. Sealing elements 41, 42 and 43 have protrusions 41*a*, 42*a* and 43*a* on the inner circumferential side, respectively. Connector 31 is provided with a tapered surface 31*t* on the outer circumferential surface. Connector 32 is provided with a tapered surface 32*t* on the outer circumferential surface. Connector 33 is provided with a tapered surface 33*t* on the outer circumferential surface. Relative to the position of tapered surface 32*t* located at the center, tapered surfaces 31*t* and 33*t* are arranged at positions shifted by distances La and Lb, respectively.

Figure 3:
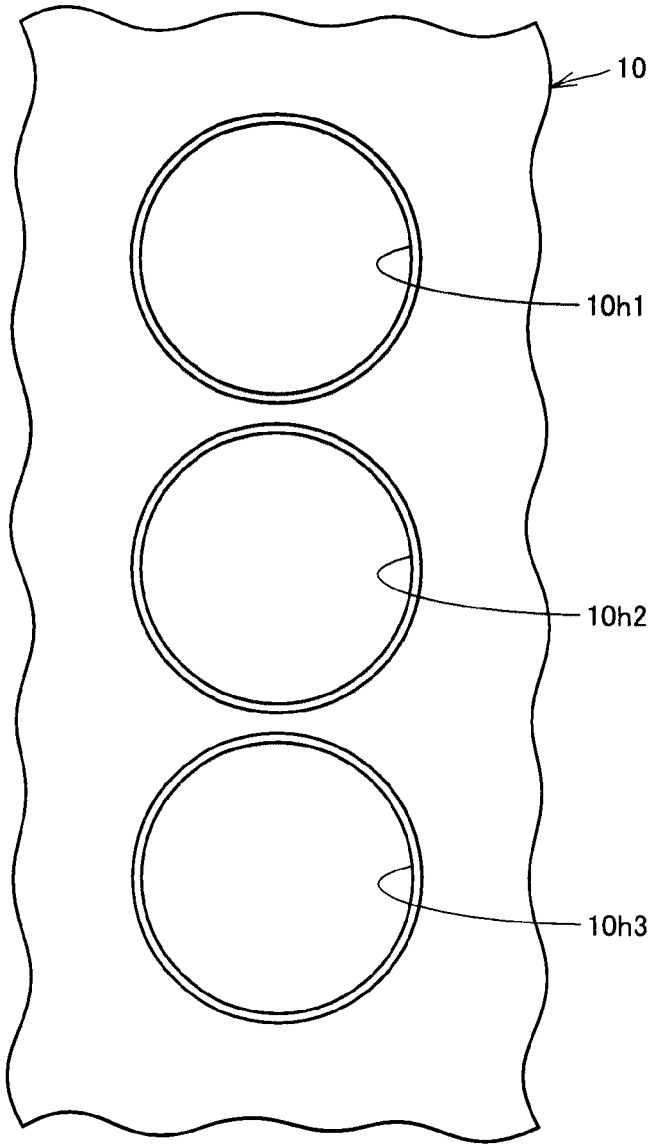
FIG. 3 is a plan view of holes 10*h*1, 10*h*2 and 10*h*3 provided in a case 10 as seen in a direction indicated by an arrow III in FIG. 2.

FIG. 3 is a plan view of holes 10*h*1, 10*h*2 and 10*h*3 provided in case 10 as seen in the direction indicated by an arrow III in FIG. 2. With reference to FIG. 3, holes 10*h*1, 10*h*2 and 10*h*3 are opened in case 10, into which the connectors are inserted. Inserting the connectors into these holes establishes an electric connection to the outside. In FIG. 3, three holes 10*h*1, 10*h*2 and 10*h*3 are arranged in series.

Figure 4:
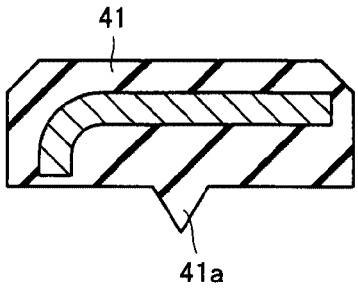
FIG. 4 is an enlarged cross sectional view of an enclosed part indicated as IV in FIG. 2, showing a sealing element 41 in detail.

FIG. 4 is an enlarged cross sectional view of an enclosed part indicated as IV in FIG. 2, showing sealing element 41 in detail. With reference to FIG. 4, sealing element 41 for sealing a connector has a metal plate at the center, and a rubber element is provided to surround this metal plate. Protrusion 41*a* is provided on the inner circumferential surface, and protrusion 41*a* forms a seal.

Figure 5:
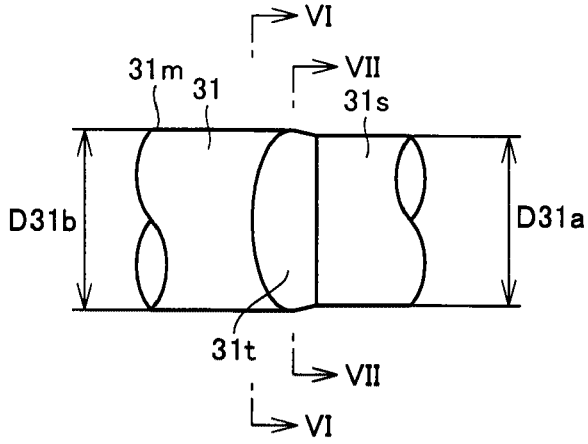
FIG. 5 is an enlarged side view of an enclosed part indicated as V in FIG. 2, showing in detail a boundary between a larger-diameter portion and a smaller-diameter portion of a connector 31.

FIG. 5 is an enlarged side view of an enclosed part indicated as V in FIG. 2, showing in detail a boundary between a larger-diameter portion and a smaller-diameter portion of connector 31. With reference to FIG. 5, a smaller-diameter portion 31*s* of connector 31 has an elliptical cylindrical shape, while a larger-diameter portion 31*m* of connector 31 has a cylindrical shape. Tapered surface 31*t* constitutes the outer circumferential surface of an elliptical cone, whose outer diameter includes a longer diameter and a shorter diameter.

It is noted that, although smaller-diameter portion 31*s* is an elliptical cylinder in this example, smaller-diameter portion 31*s* does not necessarily need to be an elliptical cylinder, and may be cylindrical. Tapered surface 31*t* only needs to constitute the outer circumferential surface of an elliptical cone.

Figure 6:
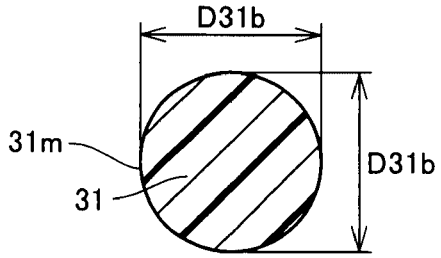
FIG. 6 is a cross sectional view of a larger-diameter portion 31*m* of connector 31 taken along the arrow line VI-VI in FIG. 5.

FIG. 6 is a cross sectional view of larger-diameter portion 31*m* of connector 31 taken along the arrow line VI-VI in FIG. 5. With reference to FIG. 6, larger-diameter portion 31*m* has an outer diameter D31*b*, and has a cylindrical shape.

Figure 7:
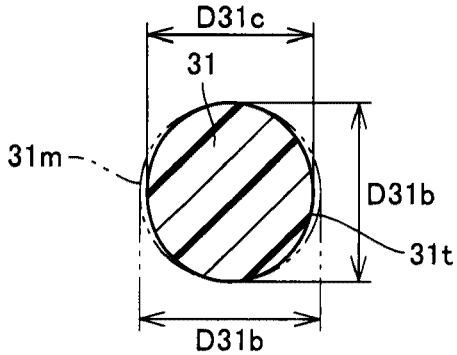
FIG. 7 is a cross sectional view of a boundary area between larger-diameter portion 31*m* and a smaller-diameter portion 31*s* of connector 31 taken along the line in FIG. 5.

FIG. 7 is a cross sectional view of a boundary area between larger-diameter portion 31*m* and smaller-diameter portion 31*s* of connector 31 taken along the line VII-VII in FIG. 5. With reference to FIG. 7, tapered surface 31*t* has an elliptical shape, whose shorter diameter D31*c* and outer diameter (longer diameter) D31*b* are different from each other. Outer diameter D31*b* is longer than shorter diameter D31*c*. It is noted that the cross section of tapered surface 31*t* is a vertically-long flat ellipse in FIG. 7, but may be a horizontally-long flat ellipse.

An assembling procedure of the fitting structure of the connectors shown in FIG. 2 will now be explained.

Figure 8:
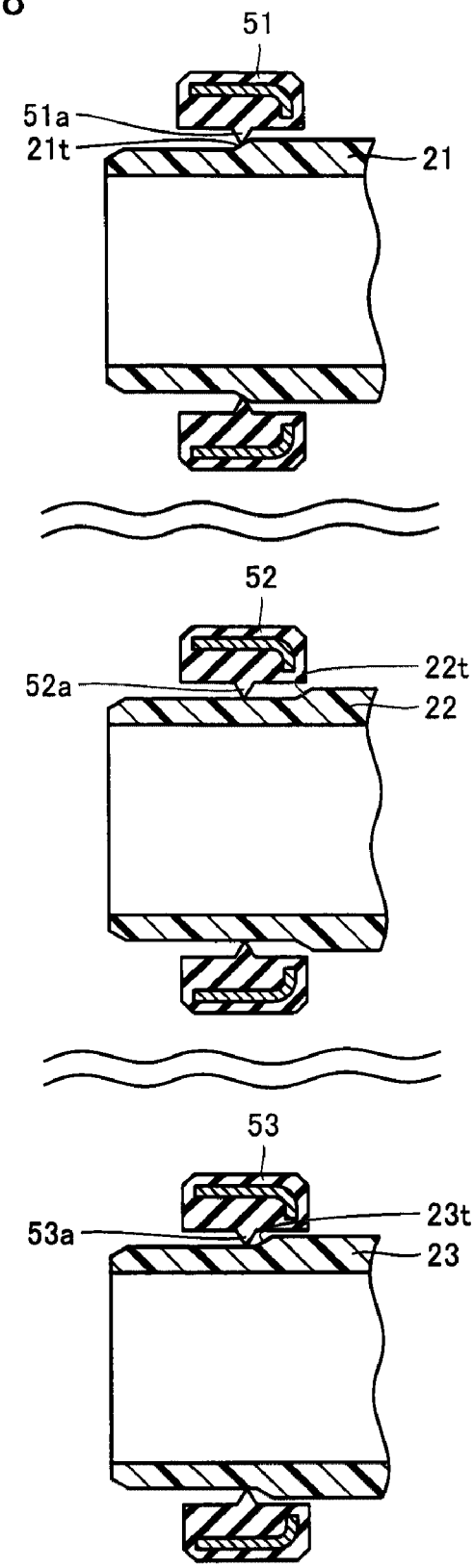
FIG. 8 is a diagram showing a fitted state between connectors 21 to 23 and sealing elements 51 to 53 for explaining an assembling procedure of a connector fitting structure shown in FIG. 2.

First, FIG. 8 is a diagram showing a fitted state between connectors 21 to 23 and sealing elements 51 to 53 for explaining the assembling procedure of the connector fitting structure shown in FIG. 2. As shown in FIG. 8, connectors 21, 22 and 23 are inserted into sealing elements 51, 52 and 53 in the holes, respectively. At this stage, tapered surface 21*t* first comes into contact with protrusion 51*a* of sealing element 51 because the respective tapered surfaces 21*t*, 22*t* and 23*t* are shifted in position. As to the remaining sealing elements 52 and 53, protrusions 52*a* and 53*a* are not in contact with tapered surfaces 22*t* and 23*t*, respectively. Inserting connectors 21, 22 and 23 slightly more deeply than the state shown in FIG. 8 causes protrusion 51*a* of sealing element 51 to run over tapered surface 21*t*, so that sealing element 51 bulges to the outer circumferential side. At this position, the insertion load during insertion of connector 21 into hole 10*h*1 is maximized.

Then, inserting connectors 22 and 23 still more deeply than the state shown in FIG. 8 brings protrusion 53*a* into contact with tapered surface 23*t*. At this stage, protrusion 52*a* is not in contact with tapered surface 22*t*. Inserting further deeply brings protrusion 52*a* into contact with tapered surface 22*t*, and then, protrusion 52*a* of sealing element 52 runs over tapered surface 22*t*, so that sealing element 52 bulges to the outer circumferential side. At this position, the insertion load during insertion of connector 22 into hole 10*h*2 is maximized. Insertion is then completed.

As described above, the insertion resistance is maximized when protrusions 51*a*, 52*a* and 53*a* come into contact with tapered surfaces 21*t*, 22*t* and 23*t*, causing a great force. Arranging the positions of tapered surfaces 21*t*, 22*t* and 23*t* such that protrusions 51*a*, 52*a*, and 53*a* come into contact with tapered surfaces 21*t*, 22*t* and 23*t*, respectively, at different time points can minimize the force required for insertion.

Figure 9:
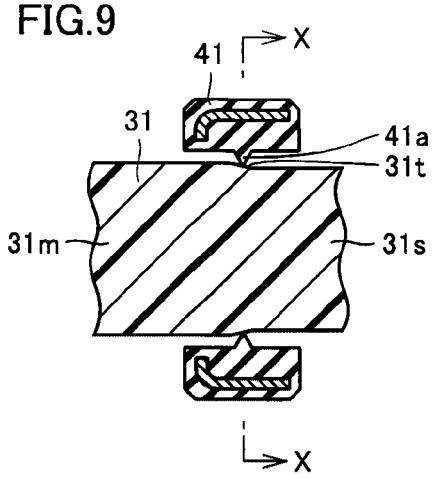
FIG. 9 is a diagram showing a contact state between a tapered surface 31*t* of connector 31 and a protrusion 41*a* during female connector insertion.

FIG. 9 is a diagram showing a contact state between tapered surface 31*t* of connector 31 and protrusion 41*a* during female connector insertion. With reference to FIG. 9, connector 31 constituting the female connector is also inserted into sealing element 41. In the state shown in FIG. 9, protrusion 41*a* of sealing element 41 is in contact with tapered surface 31*t*.

Figure 10:
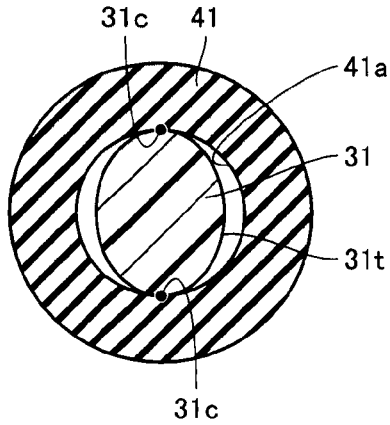
FIG. 10 is a cross sectional view taken along the line X-X in FIG. 9, showing contact points between protrusion 41*a* and connector 31.

FIG. 10 is a cross sectional view taken along the line X-X in FIG. 9, showing contact points between protrusion 41*a* and connector 31. With reference to FIG. 10, since tapered surface 31*t* has an elliptical shape, protrusion 41*a* constituting the inner circumferential surface of circular sealing element 41 and the outer circumferential surface of connector 31 are in contact with each other at two contact points 31*c*.

Figure 11:
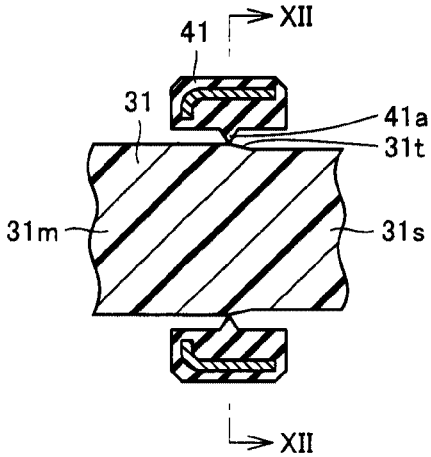
FIG. 11 is a diagram showing a state where connector 31 has been inserted more deeply than the state shown in FIG. 9.

FIG. 11 is a diagram showing a state where connector 31 has been inserted more deeply than the state shown in FIG. 9. As shown in FIG. 11, connector 31 is inserted into sealing element 41 more deeply. As a result, the cylindrical portion of connector 31 and protrusion 41*a* come into contact with each other.

Figure 12:
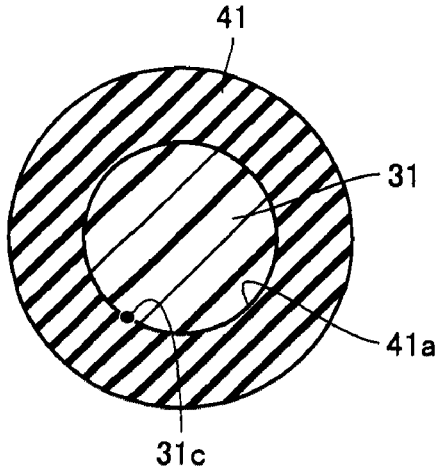
FIG. 12 is a cross sectional view taken along the line XII-XII in FIG. 11, showing a contact portion between protrusion 41*a* and connector 31.

FIG. 12 is a cross sectional view taken along the line XII-XII in FIG. 11, showing a contact portion between protrusion 41*a* and connector 31. Since the outer circumferential surface of connector 31 is circular, and protrusion 41*a* constituting the inner circumferential surface of sealing element 41 is also circular, they are in contact with each other at a plurality of contact points.

As shown in FIGS. 9 to 12, sealing element 41 and connector 31 are in contact with each other at two points in an initial stage, and the contact area gradually increases, so that the whole outer circumferential surface of connector 31 and the whole outer circumferential surface of sealing element 41 finally come into contact, as shown in FIG. 21. Therefore, the contact area can be smaller than in the case where the whole outer circumferential surface of connector 31 and the outer circumferential surface of sealing element 41 are in contact by a large area from the beginning, which can minimize the force required for insertion.

Figure 13:
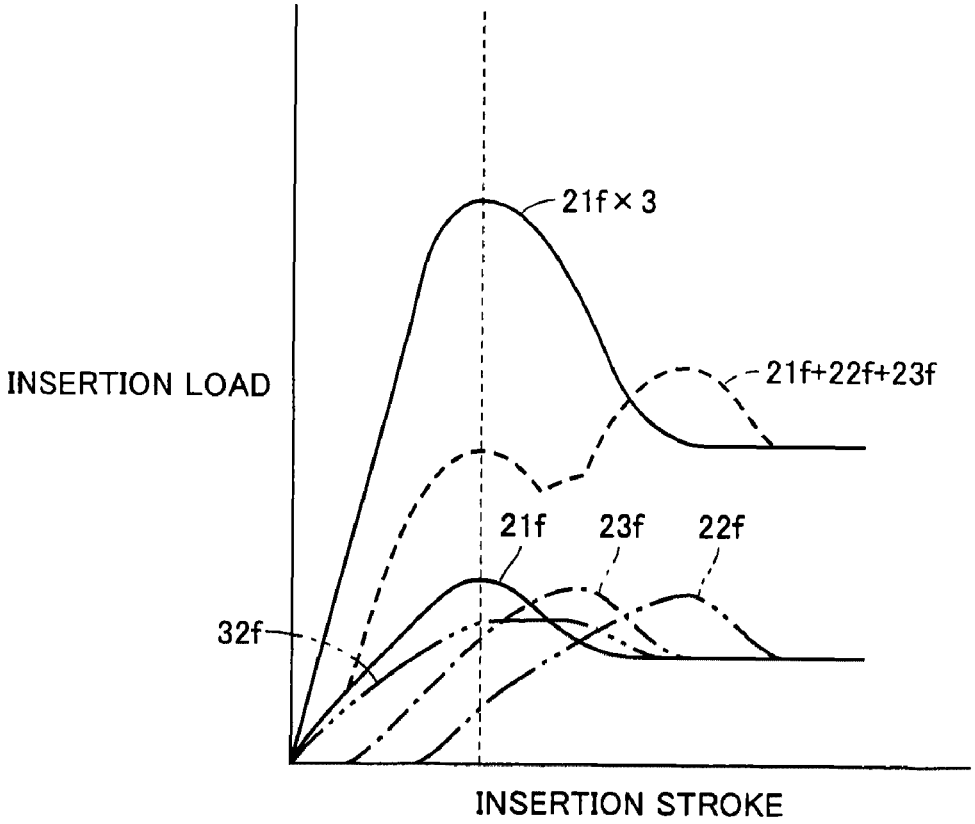
FIG. 13 is a graph showing the relation between the insertion stroke and the insertion load in the structure in accordance with the present invention.

FIG. 13 is a graph showing the relation between the insertion stroke and the insertion load in the structure in accordance with the present invention. A curve 21*f* in FIG. 13 represents the insertion stroke and the insertion load of connector 21. A curve 23*f* represents the insertion stroke and the insertion load of connector 23. A curve 22*f* represents the relation between the insertion stroke and the insertion load of connector 22. The sum of the insertion loads of these curves 21*f*, 22*f* and 23*f* is a curve 21*f*+22*f*+23*f*, representing the total of insertion loads of the respective curves. On the other hand, a curve 21*f*×3 represents the insertion load in the case where the respective tapered surfaces 21*t*, 22*t* and 23*t* are not shifted, whose value is three times the value of curve 21*f*. In this case, the insertion load increases abruptly at a time, which may make insertion difficult for an operator particularly during manual insertion.

A curve 32*f* represents a curve in the case where tapered surface 21*t* of connector 21 is an elliptical cone. In this case, the peak of the insertion load can be lowered further as shown with the example of insertion of connector 31. As a result, the composite load is also reduced further.

In this embodiment, in the sealing structure where cylindrical connectors 21, 22 and 23 are inserted respectively into sealing elements 51, 52 and 53 which are elastic members for forming a seal at a plurality of positions by a strained force, the position at which connectors 21, 22 and 23 inserted each have the maximum diameter (the uniform beveling end position) is shifted in order to improve the operability (reduce the insertion load) during insertion of the cylindrical shafts into the elastic elements.

In order to improve the operability (reduce the insertion load) during insertion of connectors 31, 32 and 33 into sealing elements 41, 42 and 43, respectively, the outer circumferential shape of each shaft inserted is an imperfect circle in an initial stage of insertion, and exhibits a perfect circle at a shifted position in the direction of insertion. Male connector 20 has a male terminal not shown on the radially inner side, while the female connector has a female terminal not shown. The male terminal is inserted into the female terminal, so that an electric current is supplied.

The connector fitting structure in accordance with the first embodiment of the present invention includes case 10 provided with holes 10*h*1 and 10*h*2 as first and second holes, male connector 20 and female connector 30 having connectors 21, 22, 31, and 32 as first and second protruding portions fitted into holes 10*h*1 and 10*h*2, respectively, and sealing elements 41, 42, 51, and 52 as first and second sealing members interposed between holes 10*h*1, 10*h*2 and connectors 21, 22, 31, and 32. When connectors 21, 22, 31, and 32 are inserted into holes 10*h*1 and 10*h*2, respectively, a position at which an insertion load during insertion of connector 21 into hole 10*h*1 is maximized is shifted in the direction of insertion from a position at which an insertion load during insertion of connector 22 into hole 10*h*2 is maximized. A position at which an insertion load during insertion of connector 31 into hole 10*h*1 is maximized is shifted in the direction of insertion from a position at which an insertion load during insertion of connector 32 into hole 10*h*2 is maximized.

Second Embodiment

Figure 14:
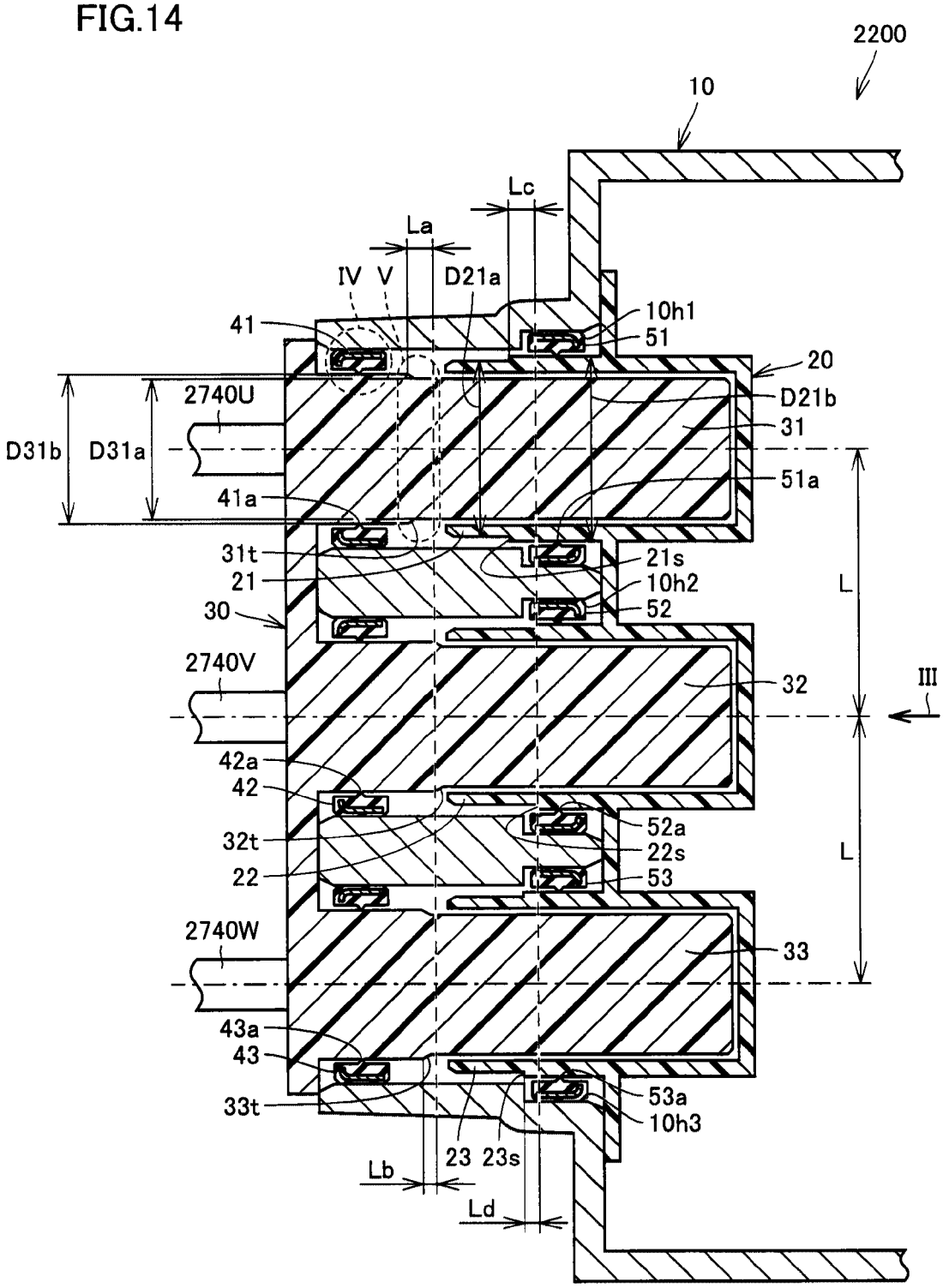
FIG. 14 is a cross sectional view for explaining a connector fitting structure in accordance with a second embodiment of the present invention.

FIG. 14 is a cross sectional view for explaining a connector fitting structure in accordance with a second embodiment of the present invention. With reference to FIG. 14, the connector fitting structure in accordance with the second embodiment of the present invention differs from the connector fitting structure in accordance with the first embodiment in that stepped portions 21*s*, 22*s* and 23*s* are provided on the outer circumferential surfaces of connectors 21, 22 and 23, respectively. Stepped portions 21*s*, 22*s* and 23*s* each have a stairstep shape, and constitute a diameter-increasing portion. It is noted that tapered surfaces 31*t*, 32*t* and 33*t* of the outer circumferential surfaces of connectors 31, 32 and 33 may be replaced by stepped portions.

Although stepped portions 21*s*, 22*s* and 23*s* in FIG. 14 are each formed by a step, stepped portions 21*s*, 22*s* and 23*s* may each be formed by a plurality of steps. Connectors 21, 22 and 23 vary in outer diameter at stepped portions 21*s*, 22*s* and 23*s*, respectively.

An assembling procedure of the connector fitting structure shown in FIG. 14 will now be explained.

Figure 15:
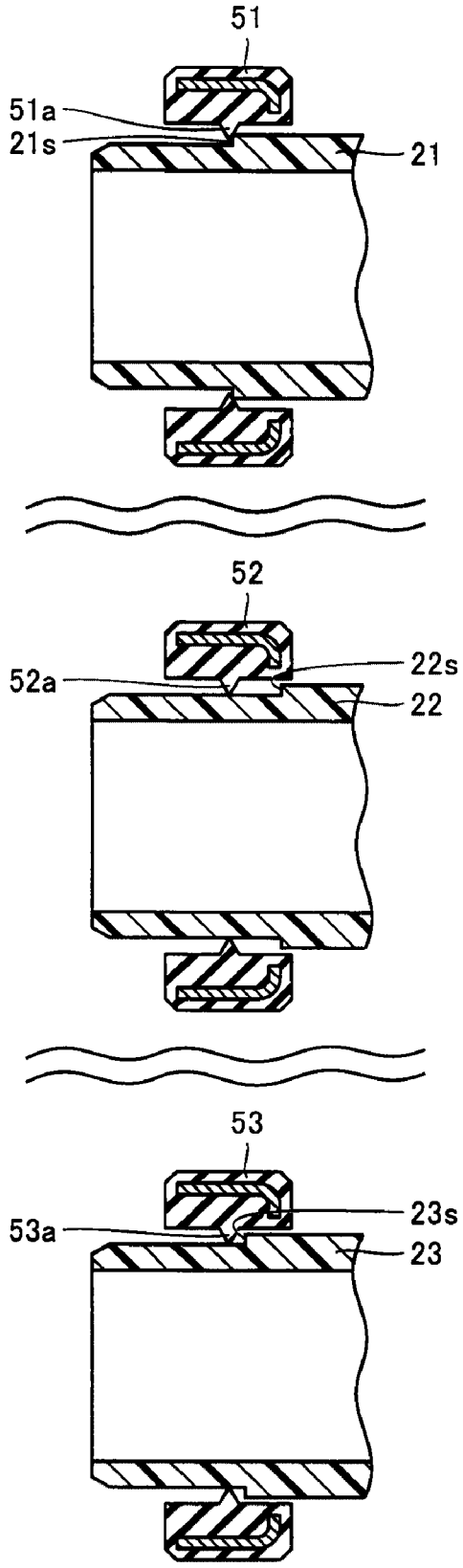
FIG. 15 is a diagram showing a fitted state between connectors 21 to 23 and sealing elements 51 to 53 for explaining an assembling procedure of a fitting structure of the connector shown in FIG. 14.

FIG. 15 is a diagram showing a fitted state between connectors 21 to 23 and sealing elements 51 to 53 for explaining the assembling procedure of the connector fitting structure shown in FIG. 14. As shown in FIG. 15, connectors 21, 22 and 23 are inserted into sealing elements 51, 52 and 53 in the holes, respectively. At this stage, stepped portion 21*s* first comes into contact with protrusion 51*a* of sealing element 51 because the respective stepped portions 21*s*, 22*s* and 23*s* are shifted in position. As to the remaining sealing elements 52 and 53, protrusions 52*a* and 53*a* are not in contact with stepped portions 22*s* and 23*s*, respectively. Inserting connectors 21, 22 and 23 slightly more deeply than the state shown in FIG. 15 causes protrusion 51*a* of sealing element 51 to run over stepped portion 21*s*, so that sealing element 51 bulges to the outer circumferential side. At this position, the insertion load during insertion of connector 21 into hole 10*h*1 is maximized.

Then, inserting connectors 22 and 23 still more deeply than the state shown in FIG. 15 brings protrusion 53*a* into contact with stepped portion 23*s*. At this stage, protrusion 52*a* is not in contact with stepped portion 22*t*. Inserting further deeply brings protrusion 52*a* into contact with stepped portion 22*t*, and then, protrusion 52*a* of sealing element 52 runs over stepped portion 22*t*, so that sealing element 52 bulges to the outer circumferential side. At this position, the insertion load during insertion of connector 22 into hole 10*h*2 is maximized. Insertion is then completed.

The connector fitting structure in accordance with the second embodiment configured as described above also exerts effects similar to those of the connector fitting structure in accordance with the first embodiment.

Third Embodiment

Figure 16:
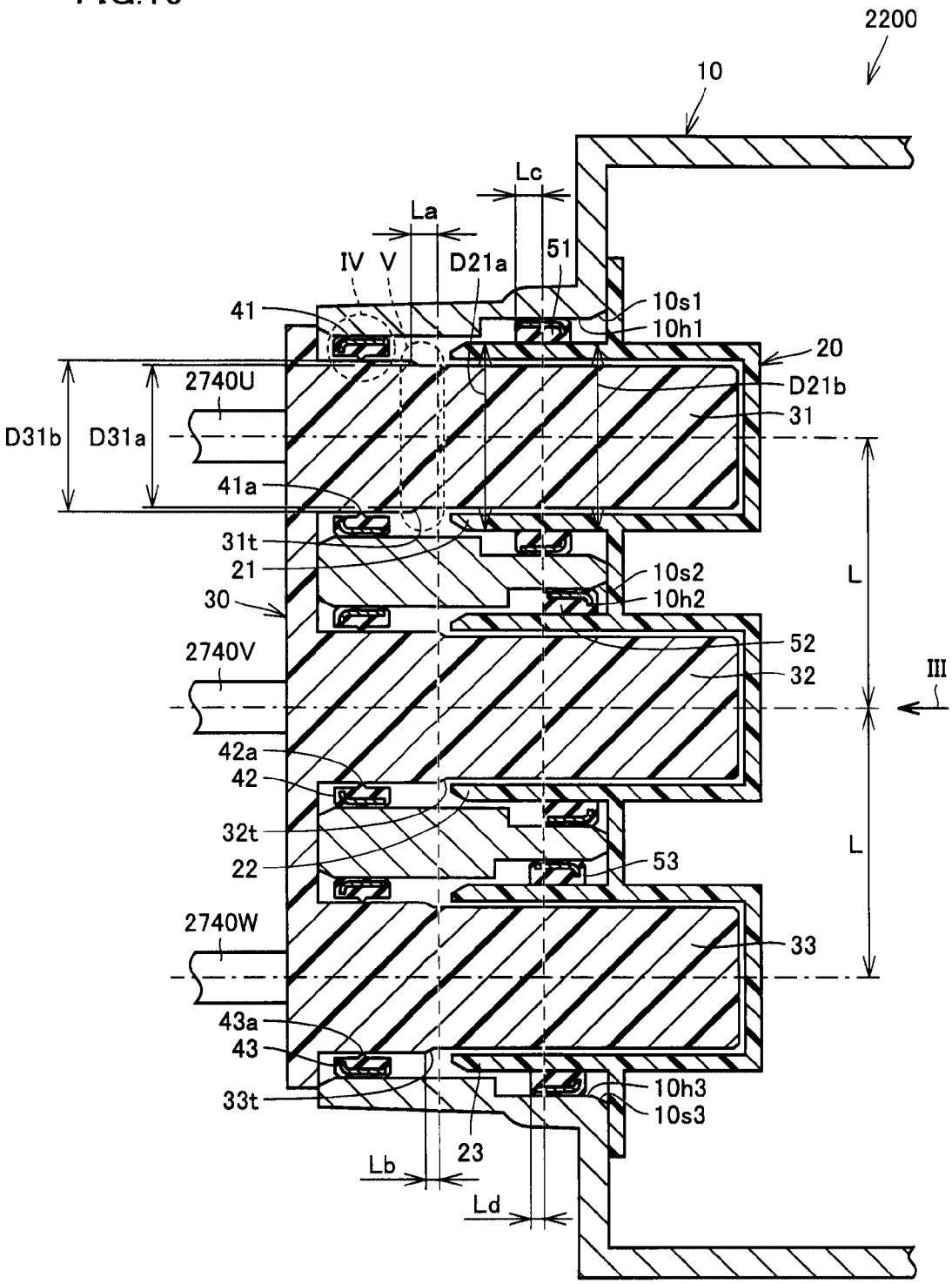
FIG. 16 is a cross sectional view for explaining a connector fitting structure in accordance with a third embodiment of the present invention.

FIG. 16 is a cross sectional view for explaining a connector fitting structure in accordance with a third embodiment of the present invention. With reference to FIG. 16, the connector fitting structure in accordance with the third embodiment of the present invention differs from the connector fitting structures in accordance with the first and second embodiments in that sealing elements 51, 52 and 53 are attached to connectors 21, 22 and 23, respectively. As shown in FIG. 16, protrusions are not provided on the outer circumferential surfaces of sealing elements 51, 52 and 53 in accordance with the third embodiment, however, circular protrusions may be provided on the outer circumferential surfaces. The positions at which sealing elements 51, 52 and 53 are attached are shifted from one another, and the position at which sealing element 51 is attached is shifted by Lc from the position at which sealing element 52 is attached. It is noted that sealing elements 41, 42 and 43 may be attached to connectors 31, 32 and 33, respectively, although being attached to case 10 in this third embodiment.

Tapered surfaces 10*s*1, 10*s*2 and 10*s*3 as diameter-decreasing portions are provided at the rims of holes 10*h*1, 10*h*2 and 10*h*3, respectively. Each of tapered surfaces 10*s*1, 10*s*2 and 10*s*3 is a conic surface, whose inner diameter varies gradually.

An assembling procedure of the connector fitting structure shown in FIG. 16 will now be explained.

Figure 17:
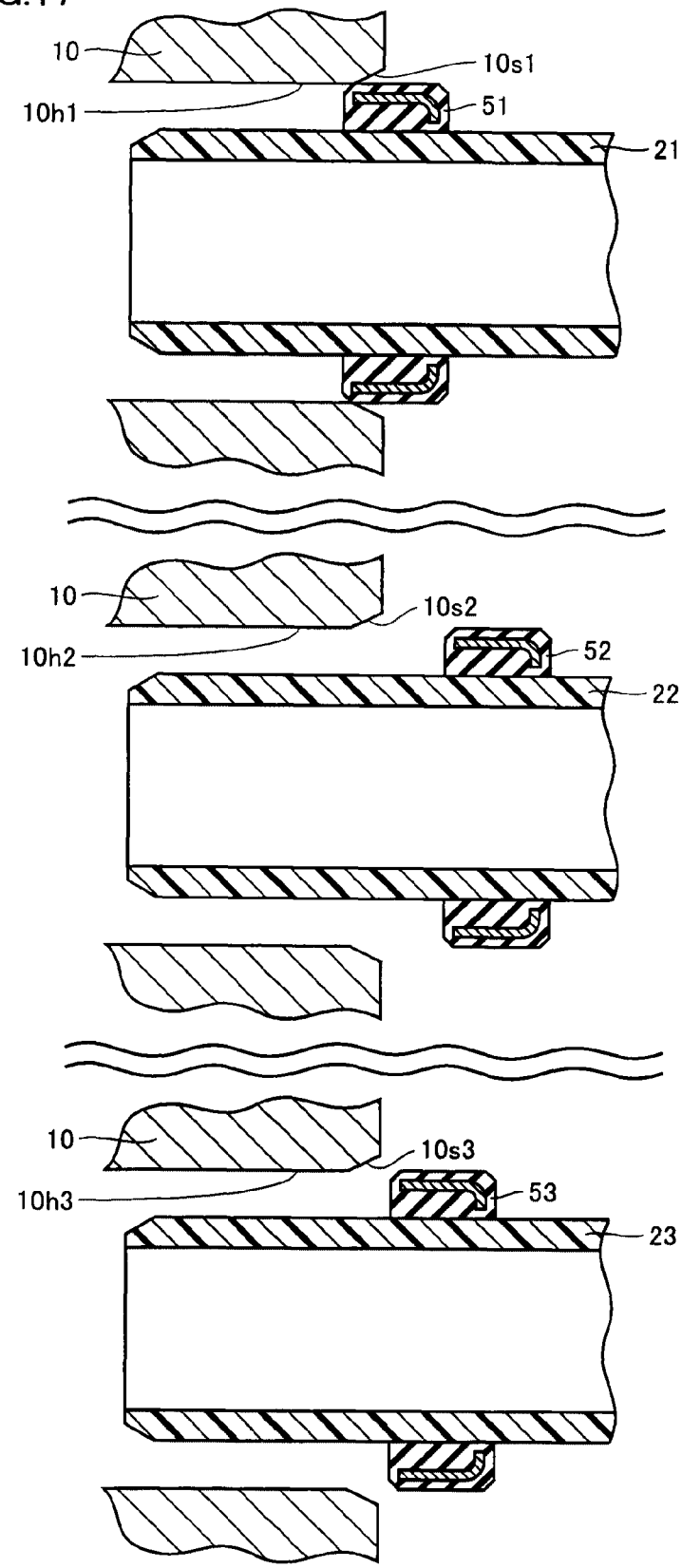
FIG. 17 is a diagram showing connectors 21 to 23 and sealing elements 51 to 53 respectively provided on their outer circumferences for explaining an assembling procedure of a fitting structure of the connector shown in FIG. 16.

FIG. 17 is a diagram showing connectors 21 to 23 and sealing elements 51 to 53 respectively provided on their outer circumferences for explaining the assembling procedure of the connector fitting structure shown in FIG. 16. As shown in FIG. 17, sealing elements 51, 52 and 53 are attached to the outer circumferential surfaces of connectors 21, 22 and 23, respectively. Sealing element 51 first comes into contact with tapered surface 10*s*1 because the respective sealing elements 51 to 53 are shifted in position. The remaining sealing elements 52 and 53 are not in contact with tapered surfaces 10*s*2 and 10*s*3, respectively. Inserting connectors 21, 22 and 23 slightly more deeply than the state shown in FIG. 17 causes sealing element 51 to be pressed against tapered surface 10*s*1 to contract to the inner circumferential side. At this position, the insertion load during insertion of connector 21 into hole 10*h*1 is maximized.

Then, inserting connectors 22 and 23 still more deeply than the state shown in FIG. 17 brings sealing element 53 into contact with tapered surface 10*s*3 to be compressed by tapered surface 10*s*3. At this stage, sealing element 52 is not in contact with tapered surface 10*s*2.

Figure 18:
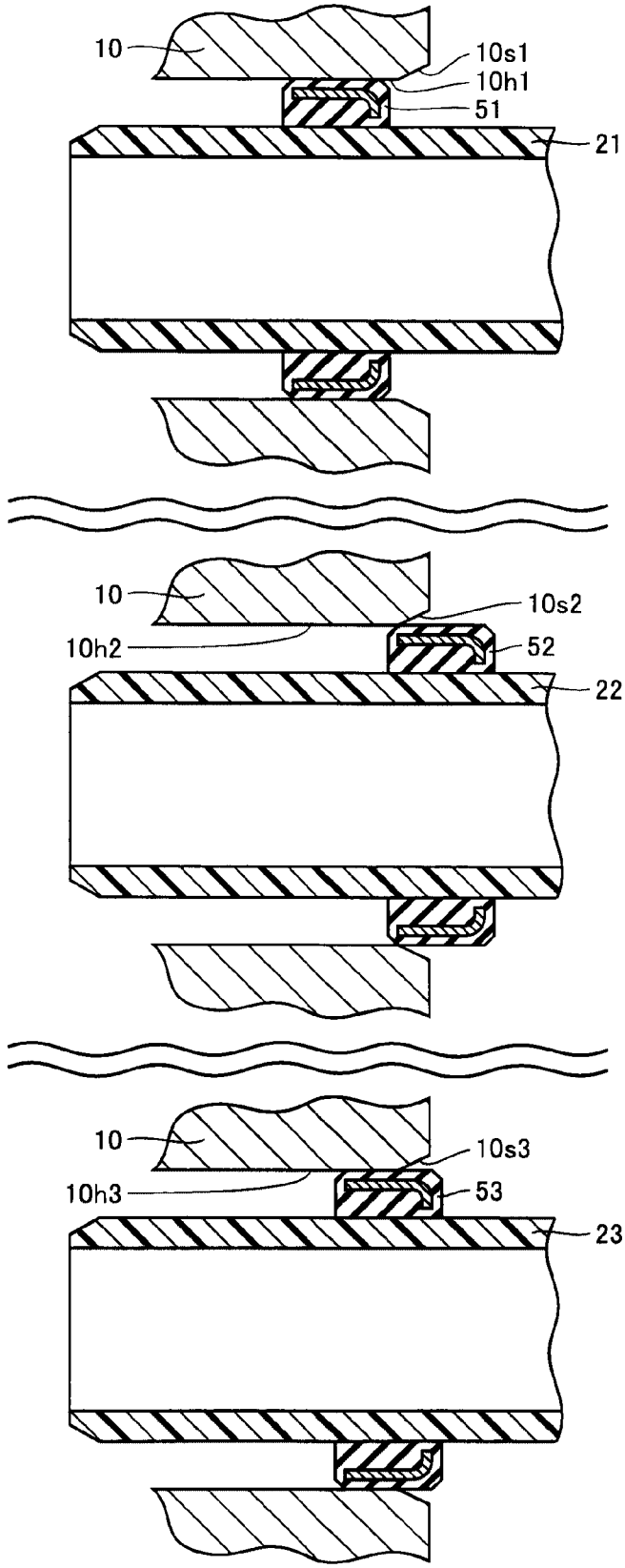
FIG. 18 is a cross sectional view for explaining contact and pressurization between a tapered surface 10*s*2 and sealing element 52.

FIG. 18 is a cross sectional view for explaining contact and pressurization between tapered surface 10*s*2 and sealing element 52. With reference to FIG. 18, inserting further deeply brings sealing element 52 into contact with tapered surface 10*s*2, and then, sealing element 52 is pressed against tapered surface 10*s*2 to contract to the inner circumferential side. At this position, the insertion load during insertion of connector 22 into hole 10*h*2 is maximized. Insertion is then completed.

The connector fitting structure in accordance with the third embodiment configured as described above also exerts effects similar to those of the connector fitting structures in accordance with the first and second embodiments.

Fourth Embodiment

Figure 19:
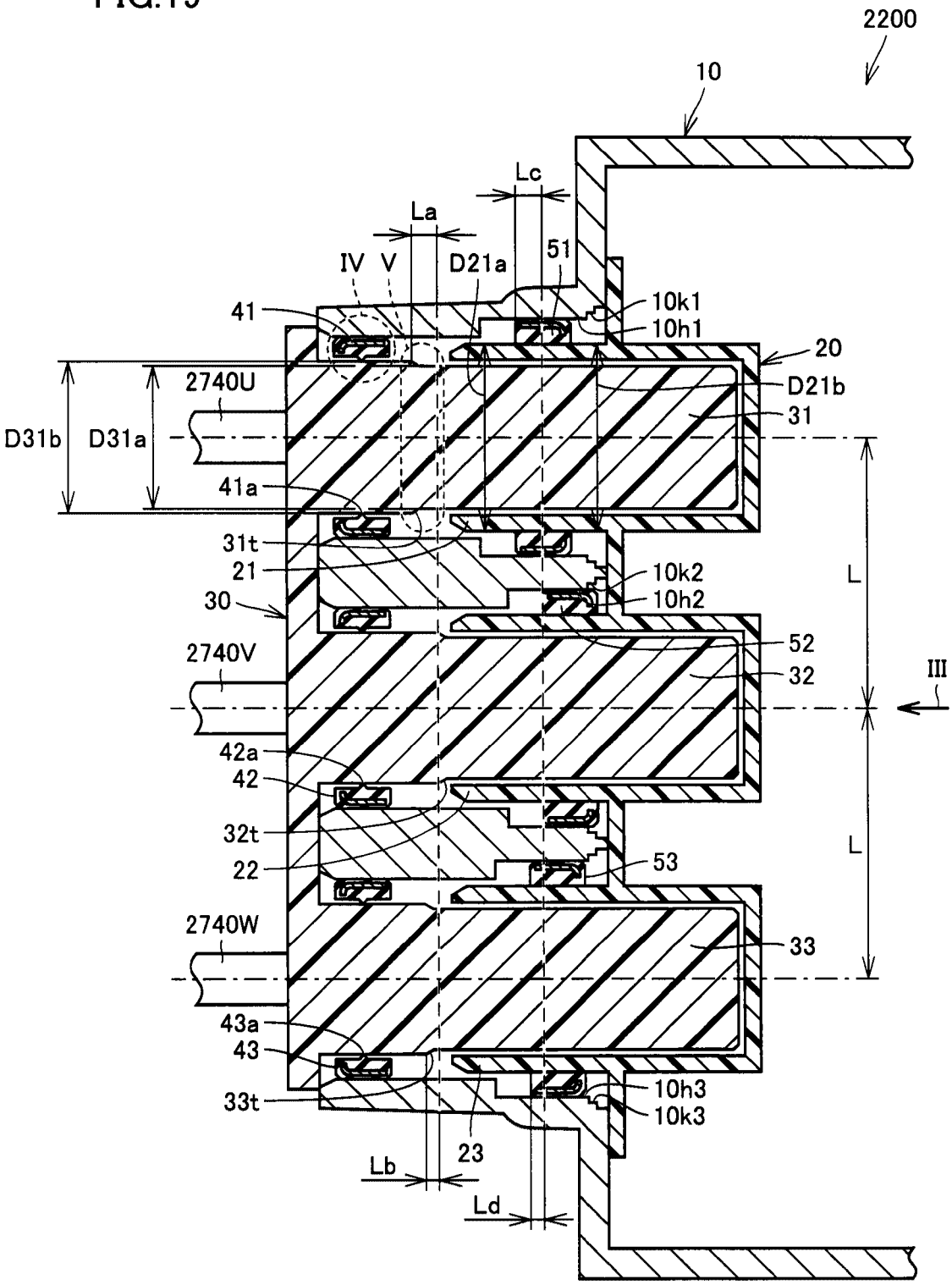
FIG. 19 is a cross sectional view for explaining a connector fitting structure in accordance with a second embodiment of the present invention.

FIG. 19 is a cross sectional view for explaining a connector fitting structure in accordance with a second embodiment of the present invention. With reference to FIG. 19, the connector fitting structure in accordance with the second embodiment of the present invention differs from the connector fitting structure in accordance with the third embodiment in that stepped portions 10*k*1, 10*k*2 and 10*k*3 are provided on the inner circumferential surfaces of holes 10*h*1, 10*h*2 and 10*h*3, respectively. Stepped portions 10*k*1, 10*k*2 and 10*k*3 each have a stairstep shape, and constitute a diameter-increasing portion.

Although stepped portions 10*k*1, 10*k*2 and 10*k*3 in FIG. 19 are each formed by a step, stepped portions 10*k*1, 10*k*2 and 10*k*3 may each be formed by a plurality of steps.

The connector fitting structure in accordance with the fourth embodiment configured as described above also exerts effects similar to those of the connector fitting structure in accordance with the third embodiment.

Although the embodiments of the present invention have been described above, the embodiments disclosed herein can be modified variously.

First, it is also possible to combine the elliptical configuration shown in FIGS. 9 to 12 with the configuration shown in FIG. 8. Sealing elements 51, 52 and 53 will each have an inner circumferential surface of a circular shape, and tapered surfaces 21*t*, 22*t* and 23*t* will have an elliptical cone shape. In this case, since the insertion load as indicated by curve 32*f* can be achieved, the peak of the insertion load can be lowered, so that smooth insertion can be achieved.

Moreover, although FIG. 8 shows the configuration in which central tapered surface 22*t* is the last one that comes into contact with protrusion 52*a* as compared to the other tapered surfaces 21*t* and 23*t*, this is not a limitation. A configuration in which tapered surface 22*t* is the first one or the second one that comes into contact with protrusion 52*a* may be adopted. It should be construed that the embodiments disclosed herein are by way of illustration in all respects, not by way of limitation. It is intended that the scope of the present invention is defined by claims, not by the above description, and includes all variations equivalent in meaning and scope to the claims.

The invention claimed is:

1. A connector fitting structure, comprising:

a case provided with first and second holes;

connectors having first and second protruding portions fitted into said first and second holes, respectively; and first and second sealing members interposed between said first and second holes and said first and second protruding portions, respectively, wherein when said first and second protruding portions are inserted into said first and second holes, respectively, a position at which an insertion load during insertion of said first protruding portion into said first hole is maximized is shifted in a direction of insertion from a position at which an insertion load during insertion of said second protruding portion into said second hole is maximized.

2. The connector fitting structure in accordance with claim 1, wherein said first sealing member is attached to an inner circumferential surface of said first hole, said first protruding portion has a diameter-increasing portion of such a shape that an outer diameter increases in the direction of insertion, and the insertion load at said first protruding portion is maximized at a position where said diameter-increasing portion abuts said first sealing member to cause said first sealing member to expand in a radial direction.

3. The connector fitting structure in accordance with claim 2, wherein said diameter-increasing portion is tapered.

4. The connector fitting structure in accordance with claim 3, wherein said first sealing member has an inner circumferential surface of a circular shape, and said tapered side surface has an elliptical cone shape.

5. The connector fitting structure in accordance with claim 2, wherein said diameter-increasing portion has a stepped shape.

6. The connector fitting structure in accordance with claim 1, wherein said first sealing member is attached to an outer circumferential surface of said first protruding portion, a diameter-decreasing portion whose inner diameter decreases in the direction of insertion is provided on an inner circumferential surface of each of said holes, and the insertion load at said first protruding portion is maximized at a position where said diameter-decreasing portion abuts said first sealing member to cause said first sealing member to contract in a radial direction.

7. The connector fitting structure in accordance with claim 6, wherein said diameter-decreasing portion is tapered.

8. The connector fitting structure in accordance with claim 6, wherein said diameter-decreasing portion has a stepped shape.

9. An electric apparatus comprising the connector fitting structure defined in claim 1.

* * * * *